US005099907A

United States Patent [19]

Dislich

[11] Patent Number: 5,099,907

[45] Date of Patent: Mar. 31, 1992

[54] APPARATUS AND METHOD FOR THE CONNECTION OF A NEW CAST STRIP IN A CONTINUOUS CASTING OPERATION

[76] Inventor: Margrit Dislich, Wolfsberg 13, D-4330 Mülheim/Ruhr, Fed. Rep. of Germany

[21] Appl. No.: 525,752

[22] Filed: May 18, 1990

[30] Foreign Application Priority Data

May 19, 1989 [DE] Fed. Rep. of Germany ..... 3916287
Sep. 12, 1989 [DE] Fed. Rep. of Germany ..... 3930459

[51] Int. Cl.[5] ..... B22D 11/00; B22D 11/08

[52] U.S. Cl. ..... 164/459; 164/418; 164/445

[58] Field of Search ..... 164/418, 459, 483, 419, 164/425, 426, 445, 446, 461

[56] References Cited

FOREIGN PATENT DOCUMENTS 231520 8/1987 European Pat. Off. .
958950 2/1957 Fed. Rep. of Germany ..... 164/425
3629043 7/1987 Fed. Rep. of Germany ..... 164/446
725323 3/1955 United Kingdom ..... 164/426
1119182 7/1968 United Kingdom ..... 164/446

*Primary Examiner*—Kuang Y. Lin
*Attorney, Agent, or Firm*—Marshall, O'Toole, Gerstein, Murray & Bicknell

[57] ABSTRACT

A method and apparatus for connecting a new cast strip to a previously cast strip after a change in batch in a continuous casting plant necessitating temporarily closing a casting die outlet including opening the casting die outlet, casting a strip of metal from the die outlet to produce a cast metal strip, attaching a connecting means to a trailing end of the previously cast strip and thereafter connecting a forward end of the new cast strip to the connecting means for concurrent movement of both cast strips. The connecting means includes a hollow connecting cuff open at lower and upper ends, and the trailing end of the previously cast strip is pressed into the lower end of the cuff, and said forward end of the new cast strip is cast into the upper end of the cuff to connect said two cast strips.

30 Claims, 5 Drawing Sheets

APPARATUS AND METHOD FOR THE CONNECTION OF A NEW CAST STRIP IN A CONTINUOUS CASTING OPERATION

FIELD OF THE INVENTION

The invention relates to an apparatus and method for connecting a cast strip during continuous casting and, more specifically, either for the connection of the end of a cold strip during starting up a continuous casting plant or for connecting a preceding strip to a new strip in a continuous casting plant. The apparatus includes an intermediate container or tundish for the liquid metal to be cast, which has an outlet port in a lower portion or bottom thereof, and includes operatively connected sealing means for closing the outlet port; and a cooled continuous casting die arranged under the outlet port, in which the connection of the fresh strip is performed with suitable connecting means. The invention further relates to a method for the connection of two strips in a continuous casting die when the batch is changed and to means for producing such a connection.

BACKGROUND OF THE INVENTION AND PRIOR ART

A method and apparatus of this type are described in the European patent publication EP 231,520 A of the same applicant. The present invention is a further development of the invention disclosed in the European application. The European publication EP 231,520 A essentially relates to means for the connection of an emerging leading end of the fresh strip which is cooling in the die, these means being connected in a conventional manner with the trailing end of a cold start strip. Although it is stated that the same means for the connection of the new strip may also be used for a case in which two strips are to be connected when the batch is changed in a continuous casting plant for securing the connecting means to the preceding strip, reference is only made to known means. The present invention generally relates to the design of the connecting means for securing to the trailing end of the preceding cast strip within the die and to significant improvements for the connection of the fresh or new cast strip.

Conventional means for the connection of the preceding cast strip, which is so halted that its trailing end, which is still hot, is still within the die, are generally in the form of a solid connecting anchor, as for example one in the form of an elongated rod with a quadrilateral (herein referred to as square) section, having an anchoring member, in an end portion, inserted in a direction perpendicular to the longitudinal axis of the rod. For connection, the square rod is pressed in a downward direction into the trailing end of the halted strip which is still hot so that after further cooling, a positive connection is produced between the anchoring member and the strip.

Depending on the particular size of cross section of the strip, such solid anchoring members are difficult to handle and position because of their considerable weight and, because they are not reusable, they make for a considerable increase in costs. Furthermore, frequently there are problems with this type of connection since the material of the preceding cast strip is often cooled down to such an extent that it is no longer possible to press one end of the connecting anchor, with its transversely placed anchoring member, into the trailing end of the strip located in the die. On the other hand, this prior art anchor always requires a certain minimum size, since it would otherwise be completely melted by the hot metal of the cast strip so that the handling and positioning problems may not be obviated by reducing the dimensions of the anchor.

SUMMARY OF THE INVENTION

It is accordingly one aspect of the present invention to provide an arrangement and a method including connecting means for the simple and reliable connection of a fresh cast strip to a trailing end of a preceding cast strip.

A still further aspect of the invention is to improve the reliability of cast strip connections, irrespective of whether the new cast strip is to be connected to a preceding strip, which is still hot, or to a cold strip for restarting the plant.

As regards the connection with the trailing end of the preceding cast strip, when batches are changed, these objects are to be attained in a simple and inexpensive manner since the connecting means is in the form of a short tubular member which, if its design does not have to meet with special requirements as regards connection with the new cast strip, in the simplest case will consist of a length of tube which is geometrically similar to (in substantial geometrical conformity with) the die cross section, but in diameter is somewhat smaller and which , preferably generally in the middle of its length, is provided with spacing elements in order to center it in the die.

The use of a cuff-like or short tubular element in place of a solid rod with a specially designed outline offers the advantage that being a hollow body it is very much more easily handled. If the diameter of the tubular cuff and the point of time of its introduction into the trailing end of the halted strip are correctly selected, since the cuff is not in the hot core of the strip, there will be no danger of the cuff being fused. Since the die is cooled, the cuff can contact the external cooling shell of the strip, which during further cooling will shrink onto the cuff so that on the one hand, a friction joint will be produced and on the other hand, however, the cuff itself will be subjected to a progressive and inwardly directed cooling effect. Owing to the shrinking of the shell of the strip onto the cuff, a frictional or non-positive joint will be produced which makes it possible to dispense with transverse anchoring parts in order to achieve a positive joint. This in turn makes it possible for the tubular cuff to be free of outwardly projecting parts which might hinder the penetration thereof into the steel which is still hot.

Although the production of a non-positive or frictional shrink-on joint has already been proposed in relation to the connection of the leading end of a new cast strip in the European patent publication EP 231,520 A, in the present invention, the connection cuff is already in its final position before the liquid steel of the new batch comes into contact with it and, furthermore, the type of contact between the liquid metal and the cuff, in accordance with the present invention, may be so controlled by the arrangement of cooling scrap and other measures that optimum conditions may be ensured for the production of the connection. On the other hand, it was surprising, and it had so far not been known that if a certain degree of care is taken, a non-positive connection may also be produced between a simple tubular section and the trailing end of a preceding strip, which has certain characteristics as regards its arrangement and its temperature variations so that there are no influencing factors, as in the case of the leading end of a fresh cast strip.

It is has been discovered that when the tubular connection cuff is pressed into the solidifying end of the previously cast strip, forces may occur which make it difficult to force the cuff into the trailing strip end as centrally as desired. If the connecting cuff is, however, pressed in eccentrically, or at a slant, so that its upper part, projecting out of the trailing strip end, runs against the wall of the die, the shrinking of a cooling strip shell of the fresh cast strip onto the upper part of the cuff may be interfered with or prevented so that there is no proper connection with the fresh cast strip. Therefore, in accordance with the present invention, the connecting cuff has spacing elements on its outer face disposed in a central section of the connecting cuff by means of which the cuff is centered, as much as possible, in the die.

It is furthermore an advantage if the connecting cuff is provided with an intermediate partition, which prevents the liquid metal of the fresh strip being cast from penetrating as far as the solidifying preceding strip. Furthermore, it is undesirable for the liquid metal to be able to penetrate between the die wall and the cuff as far as an area adjacent to the old strip, because it is here that it might fill up the shrinkage gap, possibly already formed, and thus prevent proper drawing of the strip out of the die. It is for this reason that the spacer elements are preferably so designed, or so replaced by other means, that a seal is formed surrounding the connection cuff which shuts off the gap between the connecting cuff and the inner wall face of the die.

In the case of the arrangement of both a partition in the connecting cuff and the formation of outer spacing and sealing means, a preferred design of the connecting cuff is such that the partition is in the form of a plate arrangement, which projects past the outer periphery of the connecting cuff in order at least partly to form these spacing means and the seal so that the connecting cuff itself is subdivided into an upper section and a lower section. These two sections may be connected in a suitable manner with the plate arrangement, as for instance by welding. The division of the connecting cuff into an upper section and a lower section also at the same time provides the option of making the diameters of the cuff sections with two different sizes in order to adapt them to the cooling characteristics and, thus, to the different conditions of shrinkage in the case of the old and the new cast strips. Thus the lower cuff section will preferably have a smaller diameter than the upper section of the cuff if the pressing of the cuff into the trailing end of the old strip is only able to be performed at a time at which the edge part thereof has solidified accordingly. For the connection of the new cast strip, on the other hand, the distance between the cuff and the surface of the die should not be excessive in order to ensure that the cooling down of the fused metal therebetween takes place sufficiently quickly to form a shrink-on shell.

If the plate arrangement projects past the outer periphery of the cuff sections, care is to be taken to see that, more especially in the case of joining together two strips which are still hot, there is a sufficient gap for movement adjacent to the inner surface of the die in order to prevent the strip from running askew and jamming in the die. This second gap, adjacent to the inner surface of the die, preferably is sealed by sealing material or means, which in accordance with a further development of the invention may function as a further spacing means in order to keep the second, narrower gap around the plate arrangement as concentric to the die as possible.

In the case of a double pot arrangement for the connection of two hot cast strips, the plate arrangement may consist of two plates between which there is sealing material, which is for instance in the form of a disk of flexible material, whose diameter is somewhat larger than the diameter of the plates themselves, so that the disk includes a projecting portion that seals the gap between the plates and the die face. If this sealing disk is comparatively thin, its diameter may also be so increased such that when the arrangement is introduced into the casting die, its oversized edge fits around a part of the plate arrangement in the manner of a collar to ensure that there is an effective sealing and centering action. However, there is also the possiblity of, for instance, moving a sealing ring downwards onto the projecting or proud part of the plate arrangement if the arrangement of a sealing disk under or between the plates should give rise to difficulties. It is then convenient to cover this sealing ring, which in any case should consist of refractory material, by means or material which prevents direct and initial contact with the fresh melt. This may, for example, be ensured by the arrangement of a certain amount of fine scrap or of graphite powder on the sealing ring. Even if a clamped sealing disk should be employed whose outer edge is tucked into the gap between the plate arrangement and the die surface, it may be expedient to cover over or fill up a top portion of the second, sealed off gap with graphite powder or a similar material.

The sealing off of the second gap may, however, be performed in an alternative manner. For instance, the plate arrangement may have a peripheral groove machined into it in which a suitable sealing ring is placed. Other seals, such as seal packing material, sliding ring seals and the like also are suitable. Such seal designs may be expedient if the connecting arrangement is not able to be introduced in a downward direction into the die and, instead, has to be inserted into it from below.

The double gap design described above, that is to say, an apparatus arrangement with a first larger gap between the connecting cuff and the die bore surface and a second, narrower gap between the plate and the die surface, such that the second narrower gap is preferably filled with additional sealing material, is particularly important for the connection with the fresh cast strip. All of the features of the invention described in what follows are naturally applicable in the case of the connection of two hot cast strips and in the casting of a new cast strip with a cold starting strip. For successful and trouble-free starting, the double gap arrangement is, however, particularly important. As will be further explained below, in accordance with a preferred feature of the apparatus arrangement of the invention, in the specific case of attachment of a new cast strip to a cold strip, a preferred aspect in accordance with the invention includes the feature that the plate arrangement does not have an excessively small thickness.

The broader gap adjacent to the fresh cast strip between the outer face of the cuff and the inner bore face of the die should generally have a size of between about 5 and about 50 mm and preferably between about 10 and about 15 mm in order to accommodate the fused metal, the solidification of such metal forming the first part of a strip shell shrinking onto the outer face of the cuff. The second narrower gap serves to ensure the continued existence of a certain degree of mobility of the cuff and to accommodate a sealing means which may be needed, which precludes the penetration of the fused metal into this second gap part. The width of the second gap may be preferably about 1 to about 9 mm and more especially about 1 to about 3 mm.

The second gap may., in the case of a particularly preferred form of the invention, have an axial length of about 10 to 40 mm so that the plate arrangement adjoining this gap should have a suitable thickness on the lower end of the cuff.

In the case of there being a double cuff, the lower end of the upper cuff part and the upper end of the lower cuff part are shut off by means of the steel plate.

The two cuff parts are joined together using screw or stud connections, possibly with a refractory intermediate or sealing disk between them.

The intermediate or sealing disk should have a size corresponding generally to the size of the upper die section. Since all dies for continuously casting, i.e. steel tape, downwardly are conical, this plate serves for sealing and centering the connector. The thickness of the intermediate or sealing disk is about 1 to about 30 mm and preferably about 1 to about 10 mm.

A second sealing collar arranged in the gap clearance extends preferably only along a lower part of the second gap clearance. Suitable materials used for the sealing collar are, for example, resin or fiber materials. Preferably, the sealing collar is formed as a felt disk which is positioned directly under the plate arrangement and its projecting edge part is plugged into the second gap in order to form the sealing collar. It is convenient to fill the upper part of the second gap with a granular material which prevents the penetration of the fused metal into the second gap and thus prevents the sealing collar from burning while, at the same time, allowing a certain degree of motion of the connecting arrangement within the die. Such a granular, refractory material is preferably in the form of graphite.

A further basic alternative for connection of two cuff parts in the case of a double cuff, or in the case of an upper connecting cuff connected to a cold strip is, for example, also by the use of a coupling member which is inserted through an opening in the plate arrangement into the interior of another cuff part.

Anchoring of the coupling member in the cuff part is preferably by means of one or more pins. In accordance with the invention, such a coupling member is preferably a piece of flat steel strip or a strip with a square outline.

In the case of the connection of two hot cast strips, the operation is preferably performed so that when a new batch is started, the preceding strip is stopped so that the end of the preceding strip is still in the die. After the preceding strip is stopped so that its trailing end is within the die, the connecting device in accordance with the invention is inserted downwards into the die cavity, and the lower cuff part is pressed into the trailing end of the preceding cast strip.

After this, the following cast strip from the new batch is introduced into the die, and the leading end of the following cast strip is joined in a frictional or non-positive manner with the upper cuff part of the connecting device in accordance with the invention, whereafter the two cast strips are connected to each other.

In order to make an equalization of pressure possible during this connecting operation, the plate arrangement of the connecting device in accordance with the invention is preferably provided with a plurality of gas vent holes.

Further details, features and advantages of the invention will appear from the following detailed description of the preferred working embodiments thereof with reference to the accompanying drawings.

DETAILED DESCRIPTION OF THE PREFERRED EMBODIMENT

Figure 1:
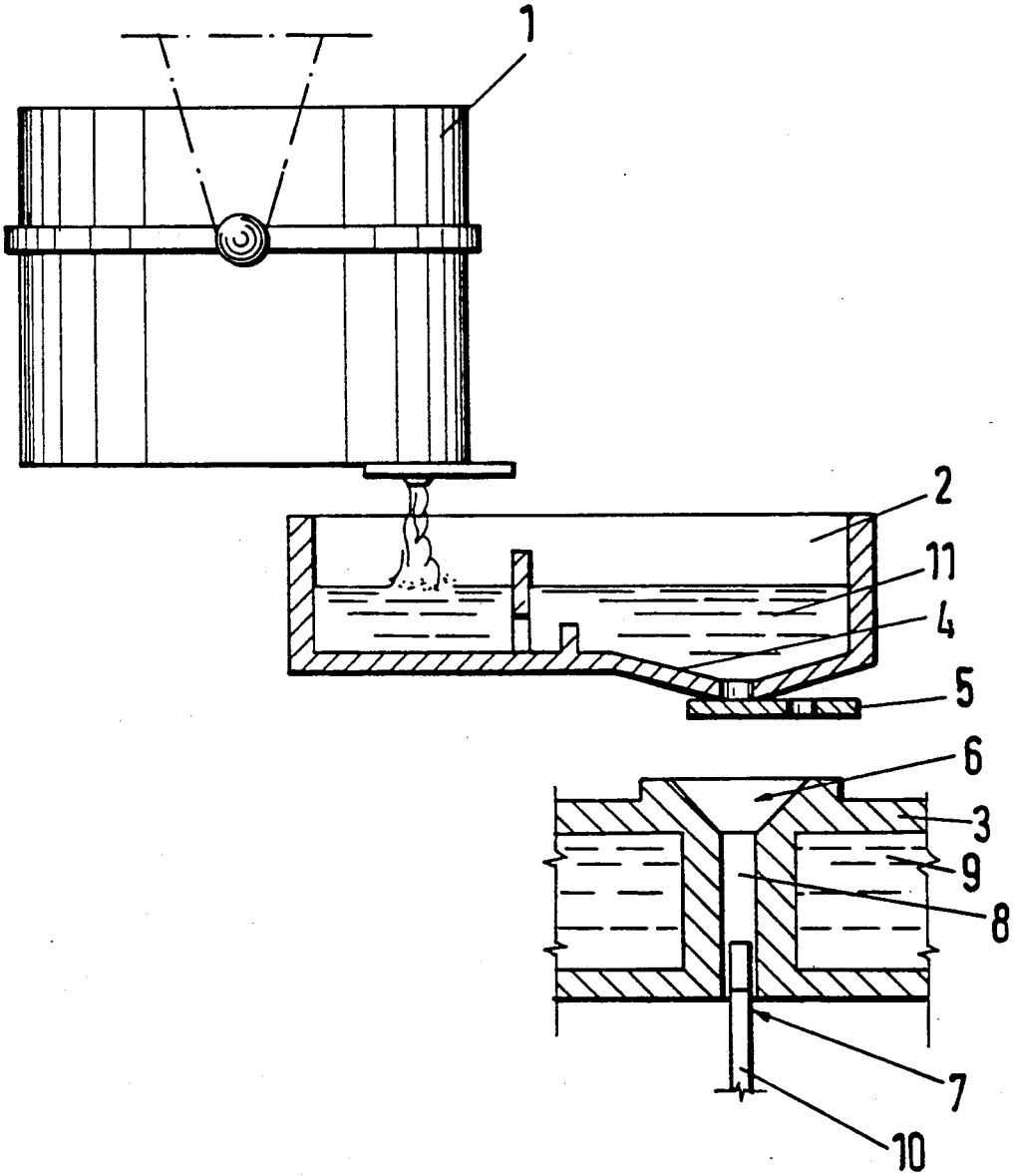
FIG. 1 is a view to show the principle of a continuous casting plant.

The partial view of FIG. 1 shows the main parts of a continuous casting plant with a ladle 1, an intermediate container of tundish 2 and the continuous casting die 3. The bottom of the tundish 2 has an outlet port 4 with a sliding gate 5 for the liquid metal. In lieu of a sliding gate 5, it would be possible to have a stopper or closing means or some other form of valve. The plant is mainly designed for the production of continuously cast steel. The casting die 3 has a die inlet 6, a die outlet 7 and a die cavity 8. The continuous casting die 3, which is only shown in part, is cooled by circulating coolant 9 around the die cavity 8.

Within the die cavity 8, there is disposed an apparatus arrangement for the connection or linking of a new cast strip, or for the linking of a new cast strip belonging to a new or to another batch, to a cold strip 10, of which only the end is shown, or a preceding hot strip 10 of which again only the end is shown. When starting up the plant, or when changing the batch, the molten metal 11 of the new batch will pass after opening the slide gate 5, out of the tundish 2 into the die cavity, shown in FIGS. 2 through 5, and which is temporarily closed at its lower end, so that the leading end of the molten metal will join to a trailing end of the cold strip 10 or the previous cast strip 10, so that the fresh cast strip, formed by the metal 11 of the new batch, will be drawn into a driving and straightening machine (not shown) placed downstream from the die.

Figure 2:
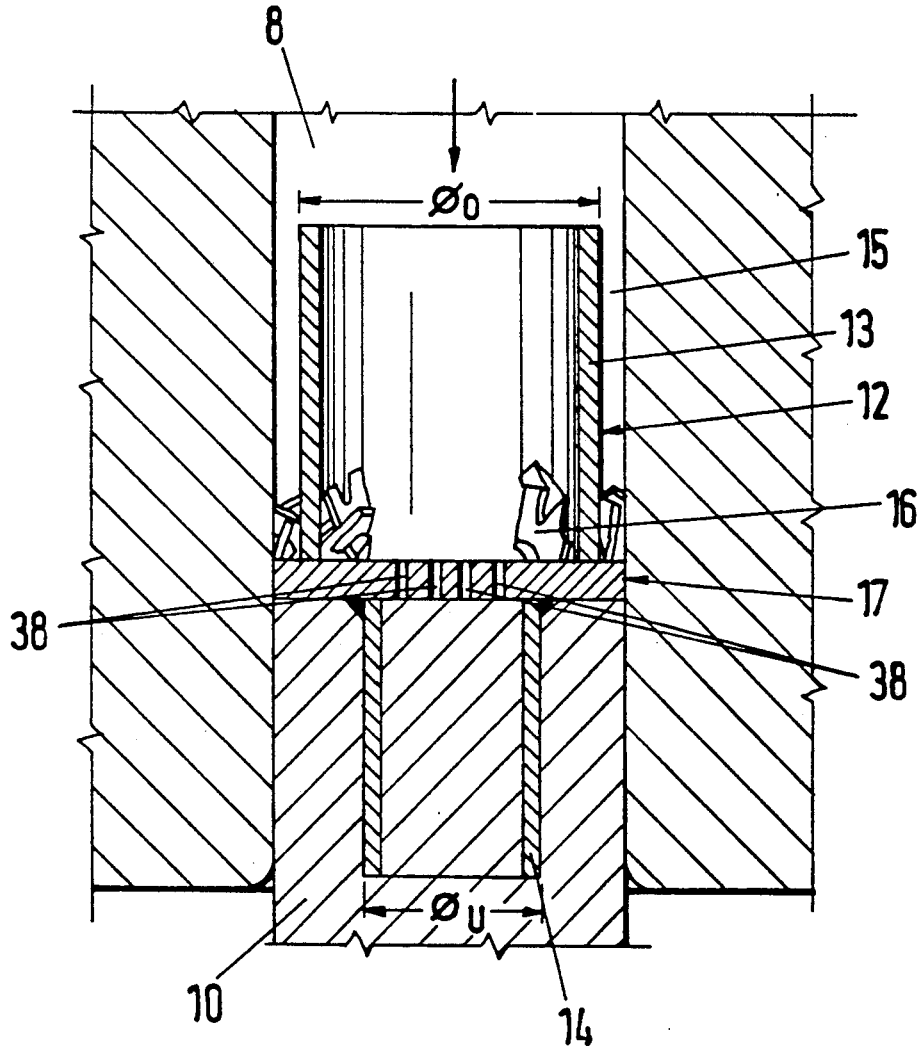
FIG. 2 is a sectional view on a larger scale of the part of the plant adjacent to the continuous casting die.

An arrangement in accordance with the invention, which may be located in the die cavity 8 of the continuous casting die 3 and whose function is the connection or linking of a new cast strip belonging to a new batch, is to be seen in FIG. 2. In the case of the working example shown in FIG. 2, there is a connecting cuff 12 placed in the die cavity 8 of the continuous casting die 3, and this cuff 12 has an upper cuff part 13 and a lower cuff part 14. As shown in FIG. 2, the cuff walls of the cuff parts 13 and 14 have a smaller diameter or cross section than the die cavity 8, the outer size of $\theta_o$ of the cuff part 13 being larger or equal to the outer size $\theta_o$ of the cuff part 14. In this respect, the gap clearance or space which exists between the inner wall face of the die cavity 8 and the outer wall face of the lower cuff part 14, is formed by the material of the preceding cast strip 10, which has already cooled down to a certain extent and thus has shrunk onto the lower cuff part 14 to form a non-positive or frictional joint therewith. This lower cuff part 14 is pressed into the preceding, or trailing end of, cast strip 10, which has been halted in the die cavity 8, for connection, when the batches are changed. Since this end of the preceding cast strip 10 has already cooled down to a certain extent, the external diameter $\theta_o$ or, respectively, the outer dimension of the lower cuff part 14, is less than or equal to that of the upper cuff part 13, which serves for connection with the following cast strip of the new batch in order to ensure than the lower cuff part 14 may be pressed into the preceding end of the lower cast strip 10 for a length of the cuff part adapted to the respective application.

As is further indicated in FIG. 2, despite the larger diameter of the upper cuff part 13, there will be a gap space 15 between the outer face of the cuff part 13 and the inner face of the die cavity, and cooling scrap 16 may be introduced into this space 15 and into the interior space of the upper cuff 13, such scrap facilitating connection of the preceding cast strip of the fresh batch.

In the case of the design shown in FIG. 2, the cuff parts 13 and 14 are secured to a plate arrangement 17, which in this form of the invention is formed by a single intermediate plate, on which the cuff parts 13 and 14 may be welded for instance. It is, however, basically also possible for the plate arrangement 17 to be formed by an intermediate plate consisting of insulating material, there then preferably being a plug connection for securing the upper and lower cuff parts 13 and, respectively, 14. In either case, the plate arrangement 17 is provided with one or a plurality of venting holes 38, which connect the two inner spaces of the cuff parts 13 and 14 with each other.

FIG. 2 also makes it clear that the plate arrangement 17 extends over the outer periphery of the upper and of the lower cuff parts 13 and 14, respectively, and reaches as far as the inner wall face of the die. As stated, it is possible for the collar-like projecting part of the plate arrangement or, respectively, the intermediate plate 17 to be charged with pieces of scrap for cooling the molten metal coming into it.

As already mentioned, on changing the batch, the one cuff part 12, representing a connecting means, is moved from above into the die cavity 8 and its lower cuff part 14 is pressed into the trailing end, which has been halted, of the cast strip 10 of the preceding batch. Further shrinking of the metal of the cast strip 10 then leads to the formation of a reliable non-positive or frictional joint between the cuff part 14 and the cast strip 10. Then, after opening the sliding gate 5, molten metal is allowed to flow into the die 3 and into the interior of the upper cuff part 13 and, on the other hand, into the gap space between the wall of the upper cuff part 13 and the die wall face. The molten metal passing into the gap space 15 is preferentially cooled by the cooled die face and also by the wall of the upper cuff part 13, where such metal solidifies and possibly melts and mingles with the wall of the upper cuff part 13 so that the beginning of a strip shell is formed, which is non-positively joined with the cuff part 13. The pieces of scrap 16 on the plate arrangement 17 clear of the cuff part 13 contribute to cooling the molten metal in the lower gap space 15 to prevent damage to the intermediate plate by the molten metal. After the connecting operation, the arrangement as so formed by the two cast strips resulting from different batches and the connecting device 12 may be moved to a driving and straightening device.

Figure 3:
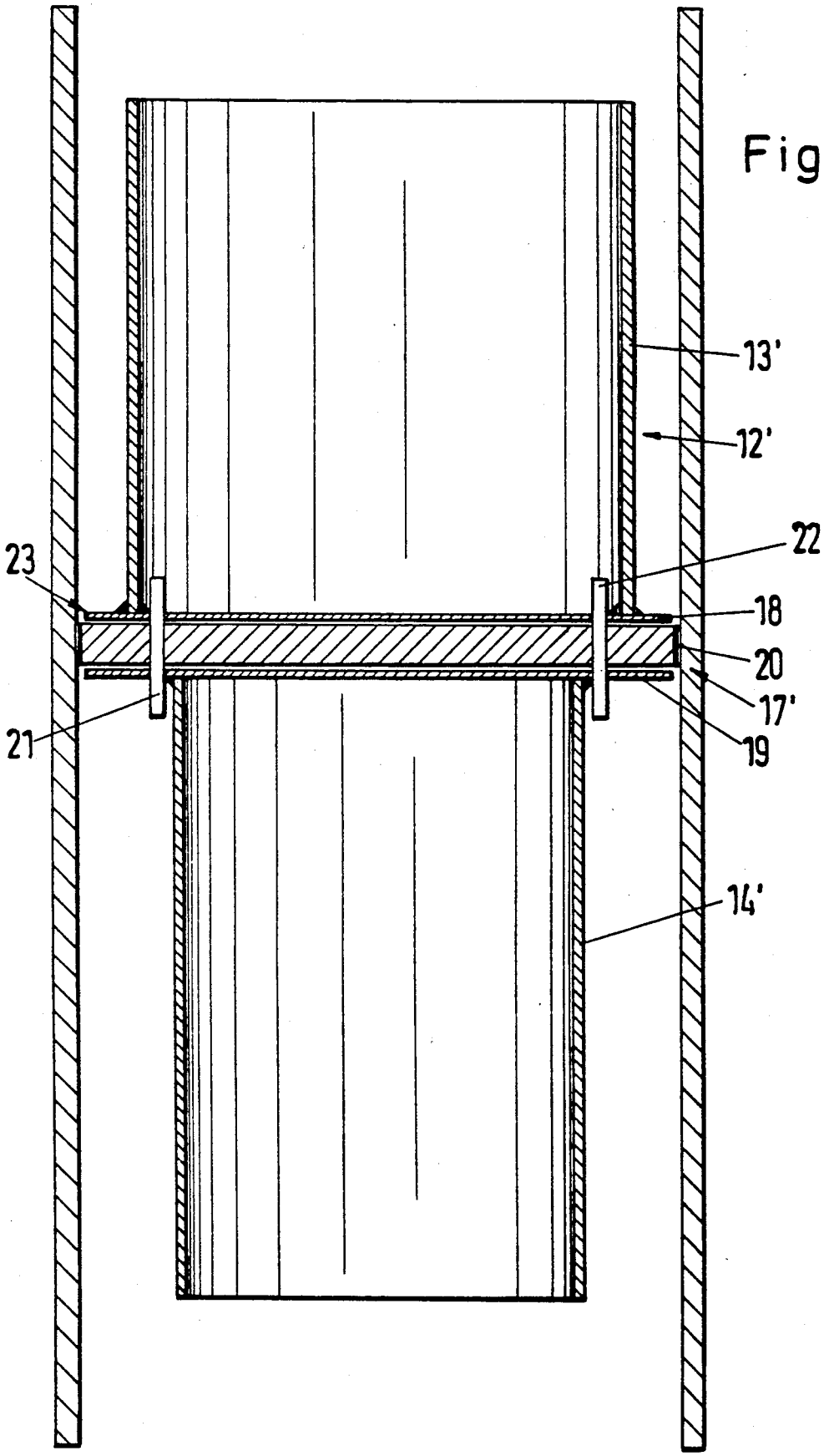
FIG. 3 is a view, corresponding to FIG. 2, in a somewhat simplified form of a second working example of the invention.

FIG. 3 shows a further working embodiment of a connecting cuff 12' in accordance with the invention. This connecting cuff 12' again, like the design of FIG. 2, has an upper cuff part 13' and 14' with larger dimensions than a lower cuff part 14'. The cuff parts 13' and 14' like the preceding embodiment of the invention, may be adapted to the cross sectional form of the respective die and thus may be, for instance, round or square. The cuff parts 13' and 14' are connected together by means of a plate arrangement 17'. For this purpose the plate arrangement 17' has an upper plate 18 not extending as far as the inner surface of the die, and a similarly designed lower plate 19 spaced from the plate 18. As indicated in FIG. 3, the upper plate 18 is welded to the upper cuff part 18' at the lower end of the upper cuff part 18'. The plate 19 is also secured by a weldment to the lower cuff part 14 at the upper end thereof in the arrangement, such upper end being opposite to the lower end of the cuff part 13'.

An intermediate or sealing plate 20 is placed in the space remaining between the plates 18 and 19 and this sealing plate 20 extends as far as the inner wall surface of the die, this being illustrated in FIG. 3 in more detail. In the design shown in FIG. 3, the sealing or intermediate plate 20 is secured between the plates 18 and 19 by means of two screw connections 21 and 22, which are only diagrammatically indicated. This design thus leads to a sealing collar 23 projecting past the external limits of the cuff parts 13' and 14' and which , in the design shown in FIG. 3, is formed by the projecting edge parts of the plates 18, 19 and 20. This design is particularly simple in structure and may thus be produced at a very low cost.

A further embodiment of the invention not shown in detail in the figures is based on the design previously described, with reference to FIG. 3, but has two cuff parts which have the same external diameter and, at their adjacent lower and upper ends, are open. In other words, in this design a continuous tube is formed which has the same dimensions along substantially its entire length and, furthermore, is best made with the same wall thickness along its length. In this embodiment, the continuous tube may be a round tube or one which is not round, i.e. specially shaped.

The external dimension of such a tube should be similar to that of the die. The gap distance between the tube and the die face is again covered over by means of a sealing collar like the sealing collar 23 in the design of FIG. 3. Owing to the continuous form of the tube, the sealing collar is arranged only on the outer periphery or, respectively, on the outer face of the tube, whereas the internal dimension of the tube may be freely selected and is not subject to any special limitations.

The last embodiment described may be used in all those cases in which a continuous cover is formed shutting off the interior space in the connecting cuff so that cooling scrap may be placed in the upper free part of the connecting cuff. Preferably, the distance between the outer edge of the upper and lower plates of the sealing collar amounts to about 1 to about 3 mm as in the design in accordance with FIG. 3. The intermediate or sealing plate has, as in the embodiment of FIG. 3, external dimensions corresponding to the inlet of the die so that, just as was the case with the design of FIG. 3, it may contribute to centering the connecting cuff owing to the taper or cone shape of the die. The thickness of the intermediate or sealing plate amounts to about 10 to about 30 mm, the preferred range being between about 1 and about 10 mm.

Figure 4:
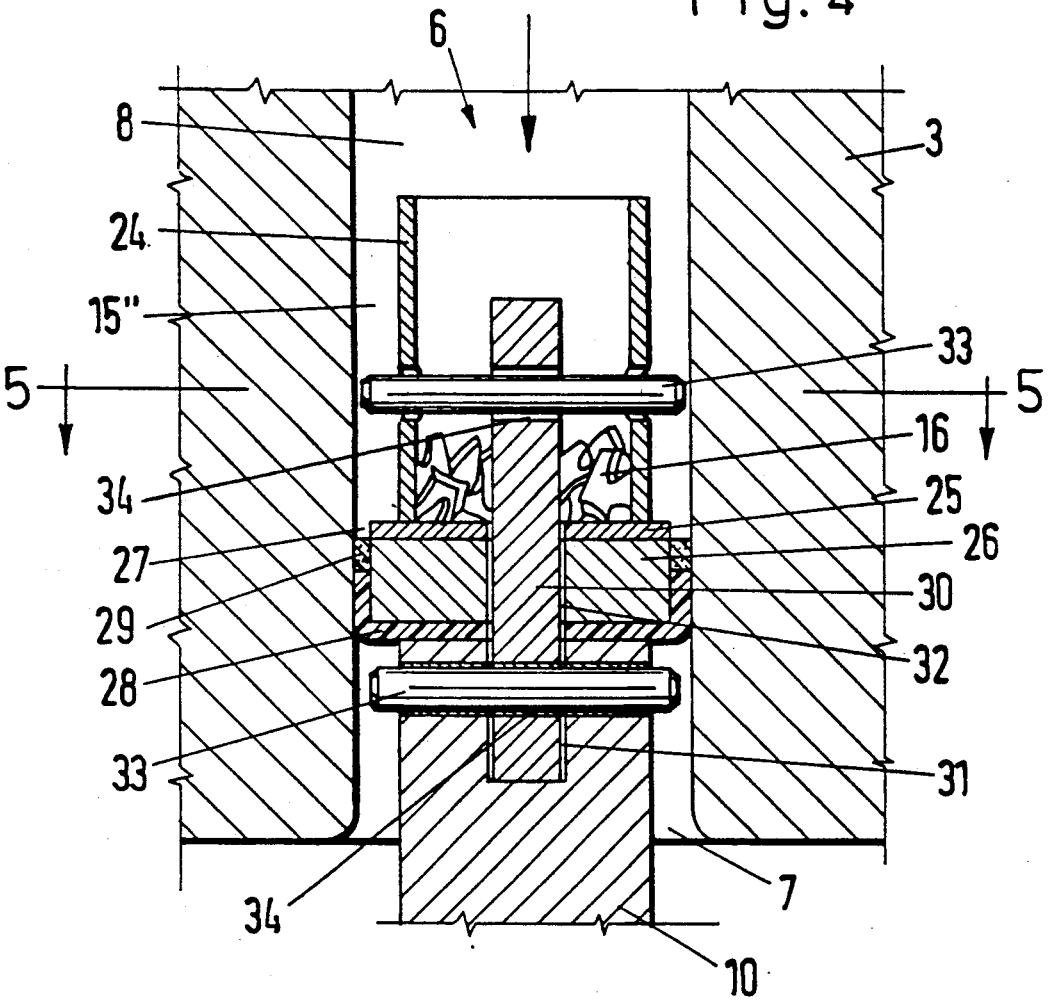
FIG. 4 is a sectional view, similar to FIG. 2, of a further working embodiment of the present invention.
Figure 5:
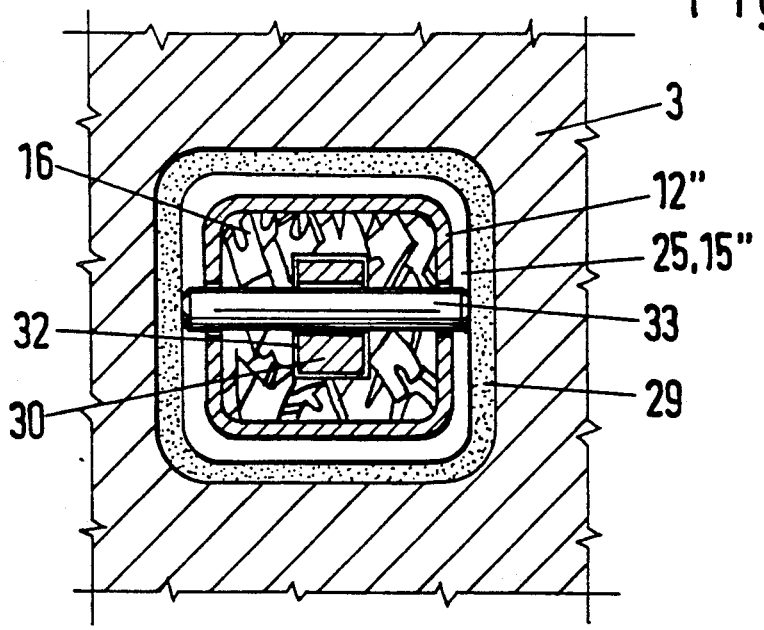
FIG. 5 is a cross section taken through the continuous casting die.

A further arrangement in accordance with the invention, which may be located in the cavity 8 of the continuous casting die, is shown in FIGS. 4 and 5. As will be seen from FIG. 4, a connecting cuff 12" is located in the cavity 8 of the continuous casting die 3, this cuff differing from the design of FIG. 2 since there is only one cuff wall 24. The connecting cuff is shut off at its lower end by a plate arrangement 25 and 26, the shape of the periphery of the cuff running in a first gap 15" extending from the die wall face. The plate arrangement 25 and 26, which is made in two parts, projects past the edge part of the connecting cuff 12". The edge of the plate arrangement 25 and 26, which is of stiff or rigid construction, cooperates with the inner die face in defining a second gap 27, which is smaller than the gap 15".

The upper broader gap 15", which is formed between the cuff wall 24 and the inner surface of the die, accepts the molten metal. An upper thinner plate 25 of the plate arrangement is located on the lower end face of the connecting cuff 12" and is welded thereto so that the lower opening in the connecting cuff 12" is essentially shut off. Furthermore, a thicker plate 26 is loosely inserted under this upper thinner plate 25, and the thickness of the plate 26 is equal to the axial length of the second narrow gap 27 and at least twice the thickness of the upper thinner plate 25. The breadth of the thinner plate 25 and of the thicker plate 26 is in this respect so selected that the narrow gap 27 is adjacent to the broader gap 15", the plates 25 and 26 having their edge parts projecting past the cuff wall 24. Accordingly, the narrow gap 27 is formed between the outer periphery of the thinner plate 25 and of the thicker plate 26 is not impaired by the molten metal. The thicker plate 26 may be provided with, for example, paper, paperboard, plastic film or a refractory film thereon.

Between the thicker plate 26 and the end of the cold strip 10, a flexible disk 28 is arranged which is provided as a sealing collar. This flexible disk 28 may be formed from, for example, a plastic, resin, elastomer or fiber material or, respectively, a felt disk and, in the inserted state of the cold strip 10, is connected with the connecting cuff 12" around the lower edge zone of the thicker plate 26 so that the narrower gap 27 is delimited by the end face of the flexible disk 28. The sealing collar so formed then consists of the upwardly bent edge part of the flexible disk 28.

In the remaining upper part of the narrower gap 27 or gap space, there is refractory, non-metallic granular material 29, such as graphite. In the interior space of the connecting cuff 12" there is cooling scrap 16 which takes up at least part of the space available.

For assembling the connecting cuffs 12" and the cold strip end, i.e.. to join them together, the invention provides a coupling member 30, which is able to be inserted into a recess 31 in the cold strip end 10 and through an opening 32 in the plate arrangement 25 and 26 into the interior of the connecting cuff 12" and may be secured in the end 10 of the cold strip and in the connecting cuff 12" and by latching means 33, as for instance, transverse pins. This coupling member 30 is preferably in the form of a piece of plain flat steel strip which is cut off from steel stock and is provided with holes 34 for the transverse pins 33. The cross sectional view of figure 5 indicates that in the illustrated example of the invention, the die 3 has a rectangular cross section. However, for those skilled in the art, it will be clear that the die may have a wide variety of different cross sections in keeping with the particular product that is to be made and that the arrangement in accordance with the invention may in fact be adapted to any particular one of these cross sectional configurations by providing the wall 24 of the cuff with a corresponding shape. The cold strip used here has a somewhat smaller cross section than the strip cast. This aspect is, however, not particularly important and the main point is that the cold strip used may be able to be supplied to the straightening machine.

After positioning the arrangement shown the FIGS. 4 and 5 and after supply of the molten metal into the die 3, a non-positive or frictional connection will be produced between the leading end of a strip shell and the connecting cuff 12" as has been explained with reference to FIG. 2. The arrangement of the cold strip and the connecting cuff with the coupled up new cast strip may then be run into the drive and straightening machine.

As regards the process, the first step is for the coupling member 30 to be introduced into the cold strip end 10 and to be secured in the same by means of the transverse pin 33. Then the disk 28 forming the sealing collar of flexible material is placed on the coupling member 30 before being placed on the end 10 of the cold strip 10.

Then the lower plate 26 of the plate arrangement, which like the flexible disk 28 naturally has an opening 32, is placed on the disk 28 in order to then place the connecting cuff 12", with the upper plate 28 welded thereon, onto the arrangement and to secure the entire subassembly by the insertion of a transverse pin 33 through the cuff wall 24 and the coupling member 30.

The assembled arrangement is then introduced from below so far into the continuous casting die that the flexible disk 28 comes out of the top of the die 3 and then moves back into the die 3. As a result, the edge part of the flexible disk 28 slips into the narrower gap 27. After this, the remaining space of the narrower gap 27 is filled, if necessary, with graphite or another suitable granular material 29. It is possible for cooling scrap 16 to be placed in the interior of the connecting 12" cuff in addition, if required. The space outside the cuff wall 24, however, remains free of pieces of scrap.

In order to detach the cold strip 10, the connection between the cold-strip and the coupling member 30 is undone, and then the lower plate 26 of the plate arrangement also may be removed for the reuse of the coupling member.

Figure 6:
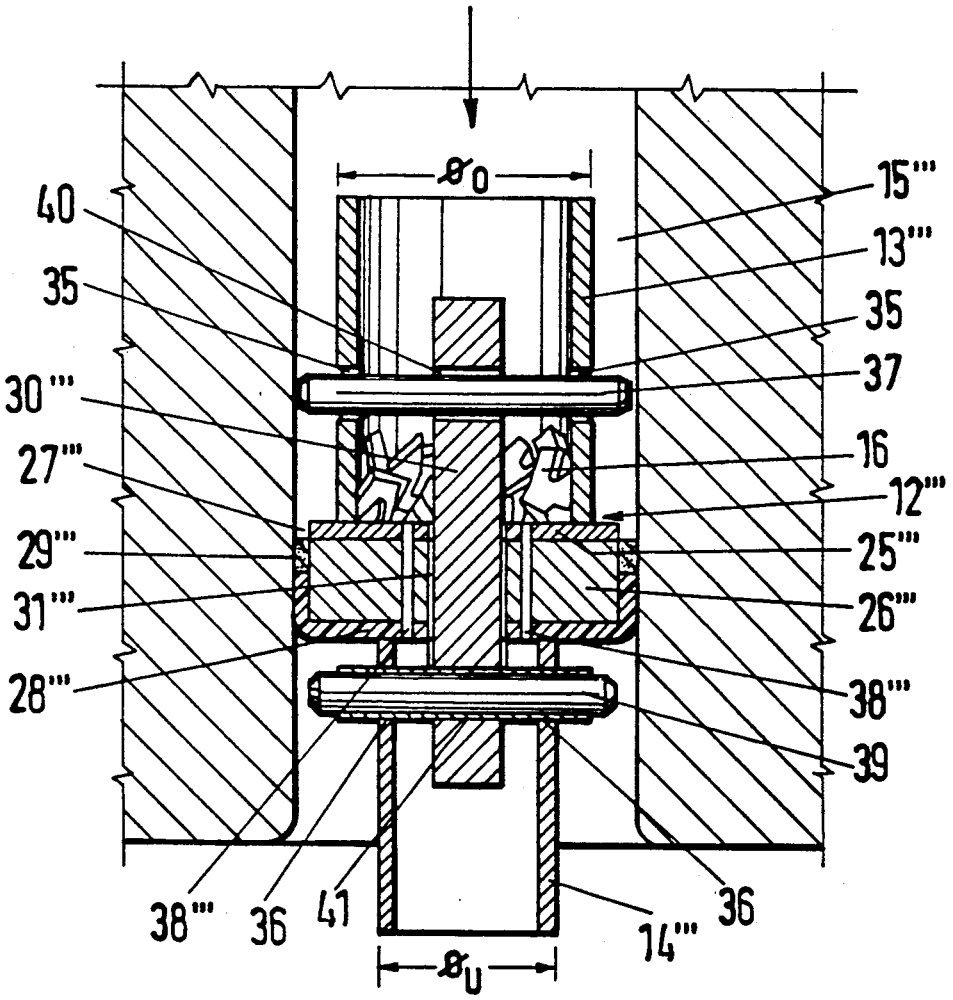
FIG. 6 is a sectional view similar to that of FIG. 2 of a further possible embodiment of the instant invention.

A further design of the arrangement in accordance with the invention is shown in FIG. 6. In the case of this embodiment, too, there is similarity with the design shown in FIGS. 2 and 3, since there is a coupling cuff 12''' in the form of two pots or bells for the connection of a new cast strip produced from another batch. Unlike the design described in connection with FIGS. 2 and 3, the cuff parts 13''' and 15''' are connected by means of a plate arrangement 25''' and 26''', which has the same features as the embodiment in accordance with the invention shown in FIGS. 4 and 5. For the requirements as regards the geometry, size, dimensions and configuration and also the function of the cuff parts 13''' and 14''', the first gap space 15''', the second gap space 27''', the plates 25''' and 26''', the flexible disk 28''', non-metallic granular material 29''' and the cooling scrap 16, the same remarks and observations apply as have been made with reference to the embodiments described in connection with FIGS. 4 and 5.

However, in contradistinction to the embodiments described in connection with FIGS. 4 and 5, there is the similarity with the embodiment in accordance with FIG. 2 that the plate arrangement 25''' and 26''' is provided with air vent holes 38''' which at least connect the cavities in the cuff parts 13''' and 14''' with each other and accordingly extend through both the plates 25''' and 26''' and also the flexible disk 28'''.

For fitting together the cuff parts 13''' and 14''', the embodiment of the connecting device 12''' in accordance with the invention shown in FIG. 6 has a coupling member 30''' which has a through hole 31''' extending through it in the plates 25''' and 26''' and the disk 28'''. It is thus possible for the ends of the coupling member 30''' to be inserted into the interior of the cuff part 13''' and, respectively, the interior of the cuff part 14'''. The cuff parts 13''' and 14''' have opening 35 and 36, respectively, at certain narrow parts through which transverse pins 37 and 39, respectively, may be inserted through suitably placed openings 40 and 41, respectively, through the coupling member 30''' and thus lock the same in place. For the material of the coupling member 30''' and the possible forms of cross section of the die, the same observations will apply as made with reference to the embodiment which are depicted in FIGS. 4 and 5 hereof.

The procedure of connection using the design of FIG. 5 is the same as the procedure for FIG. 2 so that there is a non-positive or frictional joint here as well. Unlike the design in accordance with FIG. 2, there is the advantage that the space outside the wall of the upper cuff part 13''' in the design of FIG. 6 may be kept free of cooling scrap, this enhancing the quality of the strips to be cast.

What is claimed is:

1. A method for connecting a new cast strip to a previously cast strip after a change in batch in a continuous casting plant necessitating halting the movement of the previously cast strip through a casting die thereby temporarily closing a casting die outlet comprising attaching a connecting means to a trailing end of the previously cast strip, opening a tundish outlet, casting a strip of metal from the tundish outlet to produce the new cast metal strip, with the connecting means linking the previously cast strip and the new cast strip for concurrent movement of both of said cast strips, the improvement comprising connecting said previously cast strip to a hollow connecting cuff of said connecting means, said connecting cuff open at lower and upper ends, by pressing said lower end of said cuff into the trailing end of said previously cast strip, and casting said forward end of said new cast strip into the upper end of said cuff to connect said two cast strips.

2. The method of claim 1, wherein a cross sectional contour of the cuff is in substantial geometrical conformity with a cross sectional contour of the die cavity.

3. The method of claim 1, wherein the cuff includes an outer wall and the die includes an inner wall with a gap formed therebetween.

4. The method of claim 3 comprising casting of molten metal of said new cast strip into the gap and cooling said metal to shrink fit about the cuff outer wall.

5. The method of claim 4 comprising placing cooling scrap in the gap prior to casting said molten metal thereinto.

6. Apparatus for the connection of a new cast strip to a previously cast strip after a change in batch in a continuous casting plant comprising a tundish for liquid metal, having an outlet port in a lower portion thereof adapted to be sealed by a sealing means; a cooled continuous casting die disposed under the outlet port having a die inlet, a die cavity, die cavity walls and a die outlet, a starter bar for starting a casting process wherein a previously cast strip includes a hot free end disposed adjacent to the die; and connecting means for linking the free end of the previously cast strip to a lower end of the new cast strip, said connecting means being formed in the shape of a tubular hollow member open at lower and upper ends, and having a wall cross section in substantial geometrical conformity to a cross sectional contour of the die cavity; said connecting means including spacing means operatively disposed on an outer periphery of a central portion of said connecting means to provide centering of the connecting means in the die cavity with a gap between the connecting means and an inner face of the die.

7. The apparatus of claim 6, wherein the connecting means includes a transverse wall separating the connecting means into two parts including an upper pot-like cuff part and a lower pot-like cuff part.

8. The apparatus of claim 7, wherein the transverse wall extends transversely beyond an outer periphery of the upper and lower cuff parts to space the cuff parts from the die cavity walls.

9. The apparatus of claim 7, wherein the transverse wall is in the form of a plate and wherein the upper cuff part is secured to an upper surface of said plate with an open end extending upwardly therefrom, and wherein the lower cuff part is secured to a lower surface of said plate with an open end extending downwardly therefrom.

10. The apparatus of claim 9, further including a coupling means for joining together the cuff parts, said coupling means disposed within the upper and lower plate surfaces and secured thereto.

11. The apparatus of claim 9, further including a coupling means for joining the lower cuff part to the previously cast strip end, said coupling means disposed within an opening in the plate and secured to the plate and to said strip end with a latching means.

12. The apparatus of claim 9, wherein the plate has a thickness of about 10 to about 40 mm.

13. The apparatus of claim 9, wherein the upper cuff part is spaced a first gap distance from an inner face of the die and the plate is spaced a second gap distance from the inner face of the die, said second gap distance being smaller than the first gap distance.

14. The apparatus of claim 13, including an annular sealing means disposed between an outer periphery of the plate and the inner face of the die.

15. The apparatus of claim 11, wherein the annular sealing means is formed from a flexible material selected from the group consisting of an elastomer, a non-elastomeric polymer, a resin, a felt material and a fiber material.

16. The apparatus of claim 10, wherein the first gap distance is about 5 mm to about 50 mm, and the second gap distance is about 1 mm to about 10 mm.

17. The apparatus of claim 10, wherein the plate is formed from an upper plate portion secured to the upper cuff part and a lower plate portion secured to the lower cuff part.

18. The apparatus of claim 14, wherein the plate includes a plurality of vent holes therein.

19. The apparatus of claim 14, wherein the cuff parts are secured to the plate portions by welding.

20. The apparatus of claim 14, wherein a sealing disk of flexible sealing material is disposed between the two plate portions, said disk extending beyond an outer periphery of the plate portions to form a spacing seal between the plate portions and the inner face of the die cavity.

21. The apparatus of claim 14, wherein the sealing means extends over a lower portion of the second gap, and an upper portion of the second gap is filled with a refractory granular material.

22. The apparatus of claim 21, wherein the granular material is graphite.

23. The apparatus of claim 20, wherein the cross sectional area of the lower cuff part is less than or equal to the cross sectional area of the upper cuff part.

24. The apparatus of claim 8, wherein the seal comprises a disk made of a flexible sealing material positioned under the plate.

25. In an apparatus for the attachment of a new casting strip to a cold casting strip at start up of a new batch in a continuous casting plant including a tundish for liquid metal, having an outlet port in a lower portion thereof adapted to be sealed by a sealing means; a cooled continuous casting die disposed under the outlet port having a die inlet, a die cavity and a die outlet, a starter bar for starting a casting process; the improvement comprising connecting means for connecting the new casting strip emerging from the outlet port in the new batch, said connection means including an upwardly opening cuff closed at a lower end by a transversely disposed plate having a peripheral edge, said plate operatively connected to the cuff at said lower end, said cuff including an upwardly extending wall with a peripheral transverse edge, said cuff wall disposed within the die to form a first gap between the peripheral transverse edge of the cuff wall and an inner wall face of the die, said peripheral plate edge projecting transversely beyond the upwardly extending cuff wall, said plate being formed of rigid material and disposed within the die such that said peripheral plate edge is spaced a second gap distance from the inner face of the die, said second gap being smaller than the first gap.

26. The apparatus of claim 25, wherein the plate includes an upper plate portion permanently secured to the cuff, and a lower plate portion removably connected to the cuff.

27. The apparatus of claim 26, wherein the thickness of the lower plate portion is equal to at least twice the thickness of the upper plate portion.

28. The apparatus of claim 25, further including an annular sealing means disposed to extend from the peripheral edge of the plate to seal the second gap.

29. The apparatus of claim 28, wherein the sealing means comprises a disk made of a flexible sealing material positioned under the plate.

30. The apparatus of claim 28, wherein the sealing means comprises a sealing collar disposed on the peripheral edge of the plate.

* * * * *